US005377851A

United States Patent [19]

Asano et al.

[11] Patent Number: 5,377,851

[45] Date of Patent: Jan. 3, 1995

[54] RACK ASSEMBLY

[75] Inventors: Teruo Asano, Moriyama; Shunji Nobukawa, Kagamihara; Etsuo Taniguchi; Tetsuro Yokota, both of Shiga, all of Japan

[73] Assignee: Daifuku Co., Ltd., Osaka, Japan

[21] Appl. No.: 193,810

[22] Filed: Feb. 9, 1994

Related U.S. Application Data

[63] Continuation of Ser. No. 32,755, Mar. 17, 1993, abandoned, which is a continuation of Ser. No. 893,414, Jun. 3, 1992, abandoned, which is a continuation-in-part of Ser. No. 647,714, Jan. 28, 1991, abandoned.

[51] Int. Cl.[6] ..... A47B 43/00

[52] U.S. Cl. ..... 211/191; 211/192

[58] Field of Search ..... 108/53.1, 53.5, 107, 108/108, 109, 110; 211/191, 190, 189, 192

[56] References Cited

U.S. PATENT DOCUMENTS

| | | | |
|---|---|---|---|
| 3,323,655 | 6/1967 | Foran et al. | 211/191 X |
| 3,788,490 | 1/1974 | Featherman | 211/191 |
| 4,467,729 | 8/1984 | Featherman | 211/191 X |

FOREIGN PATENT DOCUMENTS

| | | | |
|---|---|---|---|
| 921869 | 2/1973 | Canada | 211/191 |
| 479278 | of 1969 | Switzerland | 211/191 |
| 997753 | of 1965 | United Kingdom | 211/191 |

*Primary Examiner*—Ramon O. Ramirez
*Assistant Examiner*—Korie H. Chan
*Attorney, Agent, or Firm*—Barnes, Kisselle, Raisch, Choate, Whittemore & Hulbert

[57] ABSTRACT

A rack assembly having a plurality of support posts, brackets extending from individual support posts, and a bracket rail extending between two or more brackets and capable of supporting goods. An outer plate portion of each support post is formed with a plurality of vertically spaced apart engagement holes. Each bracket has engaging projections adapted to be received into the engagement holes, engaging pawls extending from the respective engaging projections and engageable with respective edges of the engagement holes, and a plate portion abuttable to the outer surface of the support post. The bracket can be mounted to the support post by inserting the engaging projections into corresponding engagement holes at the erection site to allow the engaging pawls to engage the edge of the engagement holes. Simultaneously, the slip-off preventive projection of the bracket is inserted into the slip-off preventing hole in the side plate portion of the support post. Thereby, the plate portions of the bracket is abuttable to the outer surface of each support post and thus the bracket is securely mounted to the support post.

2 Claims, 17 Drawing Sheets

RACK ASSEMBLY

This is a continuation of copending application Ser. No. 08/032,755 filed on Mar. 17, 1993 which is a continuation of Ser. No. 07/893,414 filed on Jun. 3, 1992, which is a continuation-in-part of Ser. No. 07/647,714 filed on Jan. 28, 1991 all of which have been abandoned.

FIELD OF THE INVENTION

The present invention relates to rack assemblies such as, for example, racks adapted to be installed in factories for the convenience of leading and unloading operations by forklift trucks and those for use in automatic warehousing facilities.

BACKGROUND OF THE INVENTION

Rack assemblies adapted for the convenience of loading and unloading operations by forklift trucks or goods handling devices employed in automatic warehousing facilities have been known which are of the type having a plurality of support posts arranged in spaced apart relation, both depthwise and transversely of the rack assembly, bracings and longitudinal beams for interconnecting the depthwise disposed support posts so as to securely fix them together, and transverse beams for interconnecting the transversely disposed support posts. Brackets project from each adjacent pair of the transversely disposed support posts at opposed positions, and bracket rails extend between the brackets of each adjacent two depthwise disposed support posts for supporting articles placed in the rack assembly.

In such known rack assembly, each support post has, for example, a rectangular tube shape. Usually, brackets are fixed by welding to sides of each support post at the manufacturing factory site, and bracket rails are likewise fixed by welding to distal ends of associated brackets, prior to shipment of the rack assembly. In some cases, brackets are adapted to be fixed by bolts to sides of each support post so as to be set in position at the site for rack erection.

The known rack assembly has a drawback that where assembly work is carried out in the factory, assembled rack members will occupy a large space and, in addition, shipment of same involves a high cost of transport. In the case where rack members are adapted to be fixed together by bolting, one disadvantage is that considerable time is required for assembly work at the erection site. Another disadvantage is that the rack assembly has a larger number of component parts.

The present invention is directed to eliminating the above mentioned problems, and accordingly it is a primary object of the invention to provide a rack assembly which is less expensive, can be put in assembled condition in much shorter time, and yet has higher strength.

SUMMARY OF THE INVENTION

In order to accomplish the foregoing object, according to the invention there is provided a rack assembly including vertically extending support posts disposed at least at four corners of the assembly, brackets disposed on transversely adjacent support posts at opposed positions such that the brackets on each of the support posts project toward the other suppor post, a bracket rail extending between adjacent brackets located depthwise of the rack assembly and capable of supporting goods placed in the rack assembly; said support posts each having a depthwise outwardly facing outer plate portion, a pair of side plate portions continued to opposite side edges of the outer plate portion, and a strengthening groove formed in the outer plate portion longitudinally thereof; said brackets each having a connecting member connectable to said support post, and a bracket member formed in continuation to said connecting member and to which said bracket rail is connectable; said connecting member having a side plate portion abuttable against one side plate portion of said support post, and a front plate portion abuttable against the outer plate portion of said support post, said rack assembly comprising;

a plurality of vertically long engagement holes formed at predetermined distances in said outer plate portion in the vicinities of said strengthening groove, the engaging projections formed in continuation to the end portion of said front plate portion perpendicularly to said outer plate portion, being insertable into each engaging hole respectively from the front side of said outer plate portion, locking pawls projecting downward from each engaging projection in order to engage with the lower edge of said engaging holes when each engaging projection is inserted into respective engaging hole, slip-off preventing holes formed in said side plate portions of each support post, and slip-off preventing projections formed on each bracket in order to fit in sideways with corresponding slip-off preventing holes when said engaging projections are engaged with said engaging holes from the front side of said outer plate portion.

According to the foregoing arrangement, the front plate portion and the side plate portion of the connecting member of the bracket abut against the outer plate portion and the side plate portion of the support post respectively, and the engaging projections and the slip-off preventing projections insert into the engagement holes and the slip-off holes respectively, so that the bracket can be securely supported by the support post. Therefore, when goods are loaded, a horizontal moment transmitted from the bracket member to the connecting member through the bracket rail can be positively supported so that the rack assembly is enabled to bear a large load. Furthermore, after the engaging projections of the connecting member is inserted from the front side of the support post into the corresponding engagement holes, the connecting member is pushed downward to cause the locking pawls to engage with the lower edge of the engagement holes, whereby the bracket can be easily and firmly attached to the support post. Assembly work is carried out at the erection site in this way, and accordingly the transportation cost involved can be reasonably reduced. In addition, since necessary assembly work can be performed simply by engaging the engaging projections and engaging pawls with the corresponding engagement holes, the cost of assembly work involved can also be reduced.

DESCRIPTION OF THE PREFERRED EMBODIMENTS

One embodiment of the invention will now be described with reference to FIGS. 1 through 8.

Figure 8:
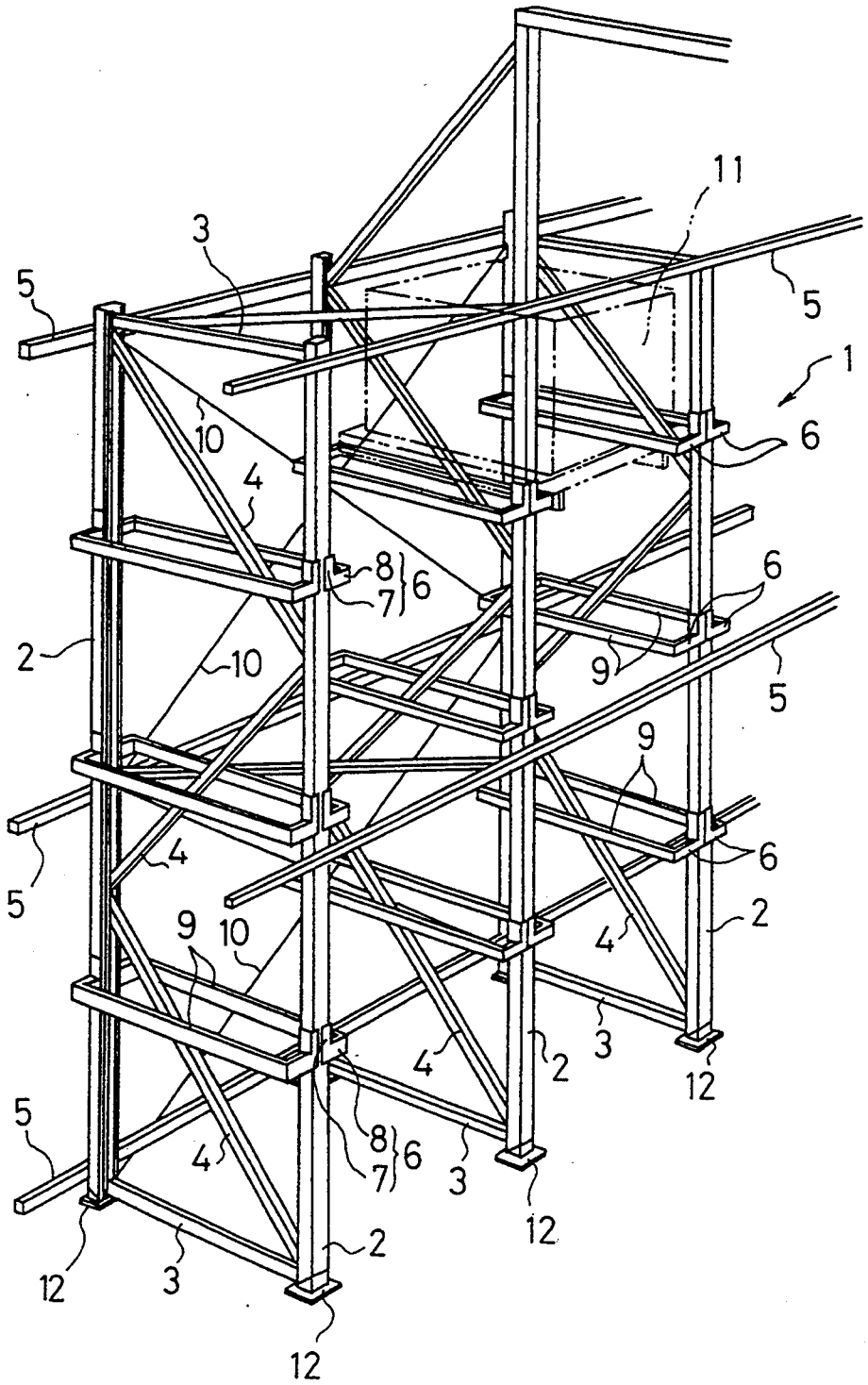
FIG. 8 is a general view in perspective of the rack assembly including the portions shown in FIGS. 1 to 7.

As FIG. 8 shows, a rack 1 has vertically extending support posts 2 spaced apart depthwise and longitudinally of the rack 1. Adjacent support posts 2 disposed depthwise of the rack 1 are connected together at their respective upper and lower ends by horizontals 3, and they are also connected by a plurality of bracings 4. In this way, each pair of support posts, front and rear, are securely connected. Support posts 2 disposed transversely of the rack 1 are connected by transversely extending horizontal beams 5 bolted in position at the front and rear sides of the rack 1.

Each support post 2 has brackets 6 removably attached thereto which project horizontally toward transversely spaced adjacent support posts 2. Each bracket 6 comprises a connecting member 7 fitted to the support post 2 and a bracket member 8 continued to the connecting member 7. Respective bracket members 8 of each two adjacent support posts 2 spaced depthwise of the rack 1 are connected at their distal ends by a bracket rail 9 supporting goods 11 at the lower end thereof. Adjacent support posts 2 at the rear side of the rack 1 are connected, at diagonally opposed joints between respective support posts 2 and horizontal beams 5, by a diagonally extending reinforcing bracing 10. A seating member 12 is secured to the lower end of each support post 2.

As FIGS. 1 to 6 show, each support post 2 comprises outer and inner plate portions 21, 22 formed in opposed relation and a pair of side plate portions 23, the inner plate portion 22 being centrally formed with a longitudinally extending slit 24. A longitudinally extending strengthening groove 25 is formed in the outer plate portion 21 at a location opposite to the slit 24. The inner plate portion 22 is formed with a pair of connecting plate portions 26 bent 90° outwardly from opposite edges of the slit 24 and extending in parallel along the slit 24. Ends of horizontals 3 and bracings 4 are fitted in the space between the connecting plate portions 26 and fixed in position by rivets or the like.

The strengthening groove 25 has a depth D and comprises a bottom plate 25*a* and side plates 25*b*, 25*b*. Corner portions defined by the bottom plate 25*a* and side plates 25*b*, as well as corner portions defined by the side plates 25*b* and outer plate portion 21, are bent at right angles. A pair of engagement holes 27A, 27B are formed vertically spaced apart at a predetermined distance in the vicinities of the strengthening groove 25 formed in the outer plate portion 21. The side plate portions 23 are formed with a slip-off preventing hole centrally at a location corresponding to the lower engagement hole 27B.

The connecting member 7 and bracket member 8 of each bracket 6 are integrally formed by pressing into an L shape. The connecting member 7 has a front plate portion 31 abuttable to one side of the outer plate portion 21 of each support post 2, a side plate portion 32 bent 90° from the front plate portion 31 and abuttable to one side plate portion 23 of the support post 23. The front plate portion 31 has, at upper and lower ends thereof, engaging projections 34A, 34B integrally formed therewith by pressing or the like and bent rectangularly toward the support post 2 which are insertable into the engagement holes 27A, 27B. The engaging projections 34A, 34B are formed at their respective lower ends with locking pawls 35A, 35B adapted to be locked to the lower ends of the engagement holes 27A, 27B.

Each bracket member 8 includes a front plate 36 continued evenly from the lower end of front plate portion 31 of the connecting member 7, an upper plate 38 continued from the side plate portion 32 of the connecting member 7 through a curved portion 37, and a lower plate 39 bent 90° rearward along the lower end of the front plate 36 so that it has a channel shaded section. The bracket member 8 is provided at its front end with an end plate 40 having a connecting hole 40*a*. The proximal end of the lower plate 39 which abuts one side plate portion 23 of the support post 2 when the rack is assembled into shape is formed with a slip-off preventing projection 41 engageable with the slip-off preventing hole 28.

Figure 5:
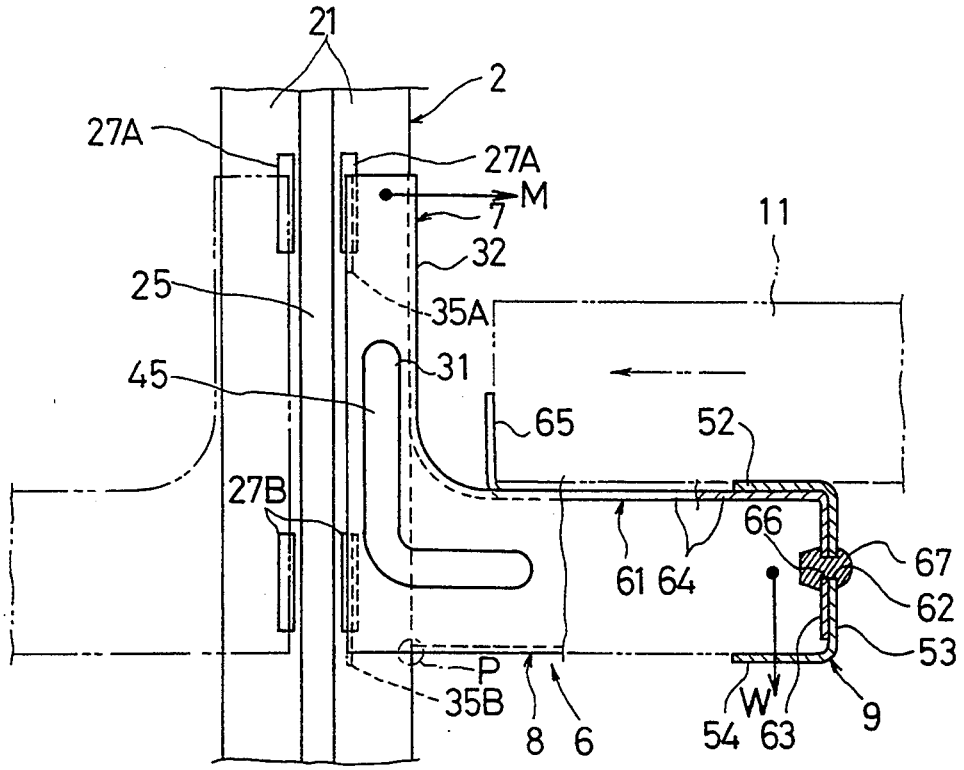
FIGS. 5 and 6 are, respectively, a partial cutout front view and a side view of the portions shown in FIG. 1.
Figure 6:
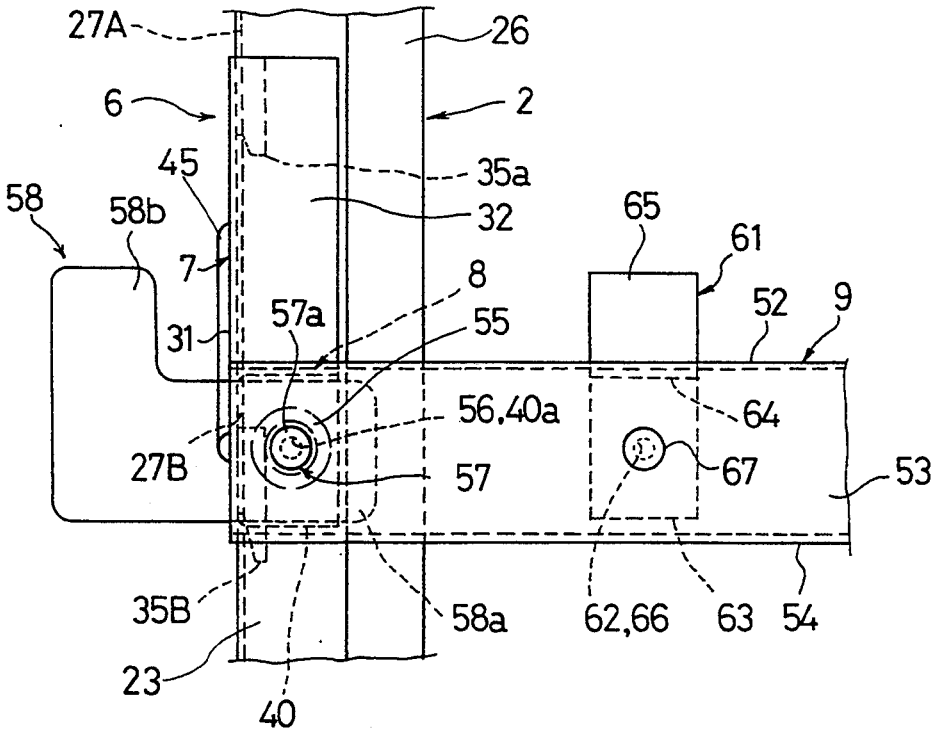
Figure 7:
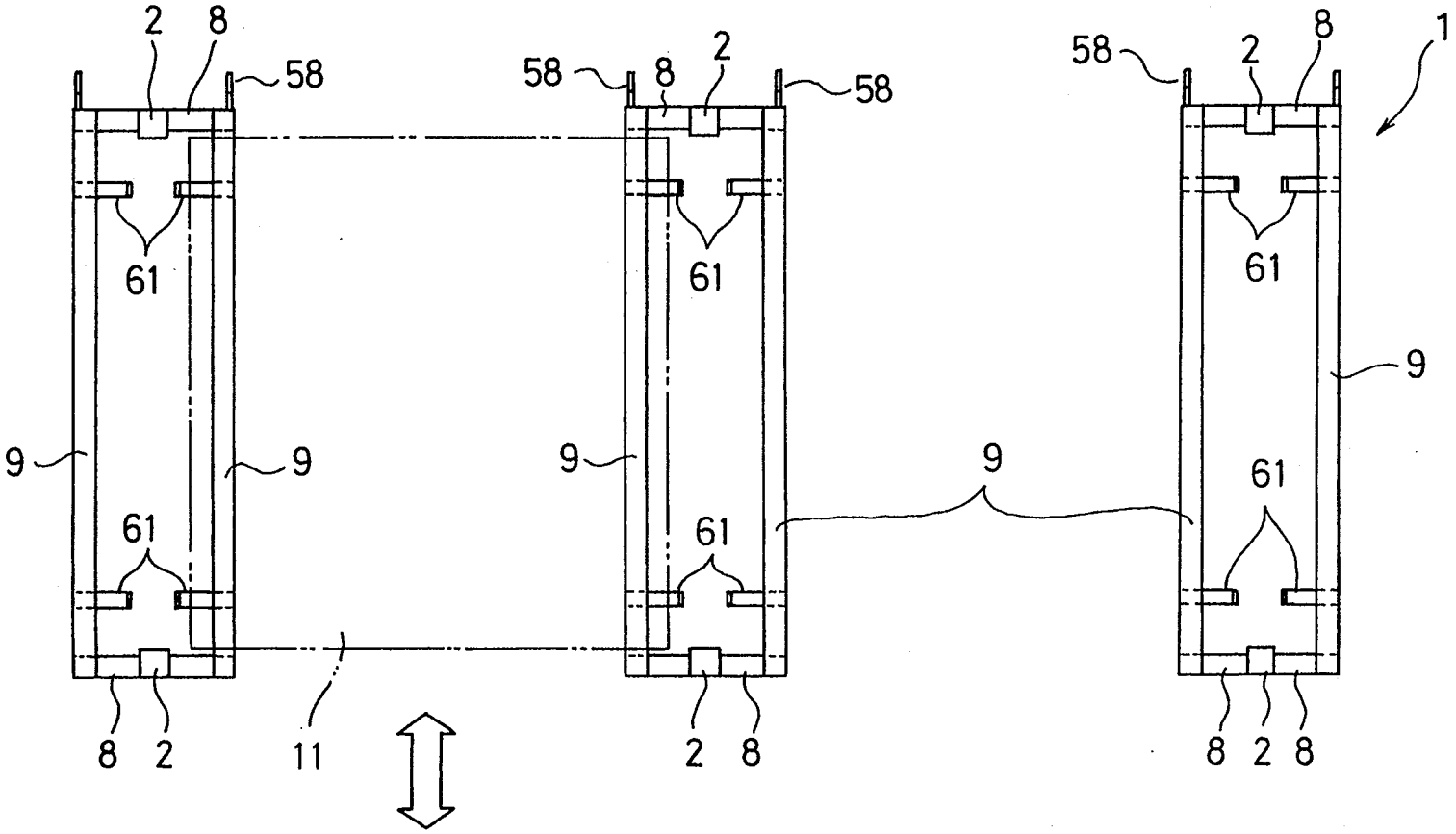
FIG. 7 is a plan view of the portions shown in FIGS. 1 to 6 covering a broader range of the rack assembly.

A strengthening raised portion 45 having an L shape as viewed in front elevation is formed by pressing on a combination of the front plate portion 31 of the connecting member 7 and the front plate 36 of the bracket member 8. This strengthening raised portion 45 prevents a strain 46 from being caused to the front plate portion 31 when a large load W is applied to the front end portion of the bracket member 8 as shown in FIG. 5.

Figure 1:
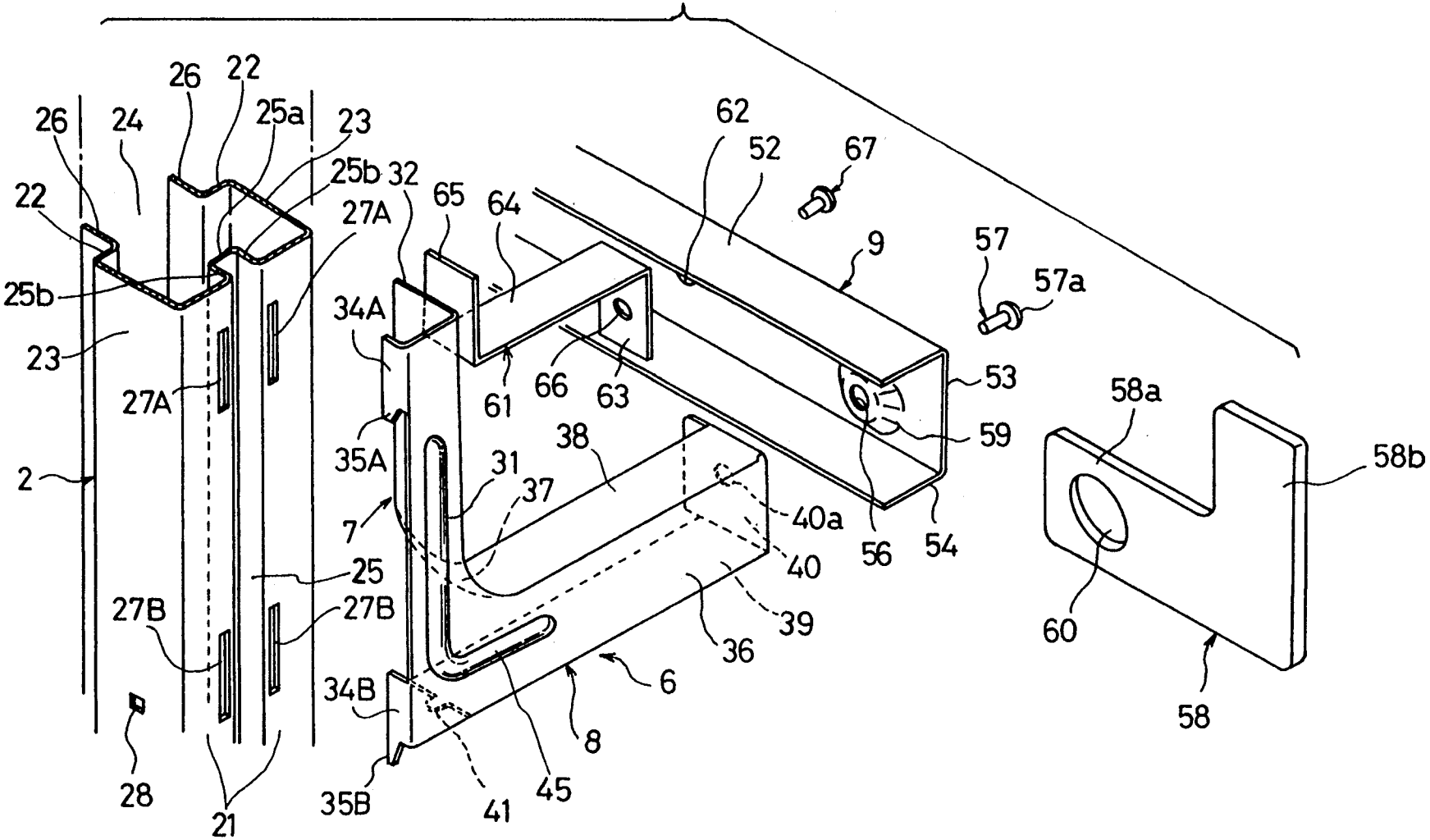
FIG. 1 is a fragmentary exploded view in perspective of a rack assembly representing one embodiment of the invention.
Figure 2:
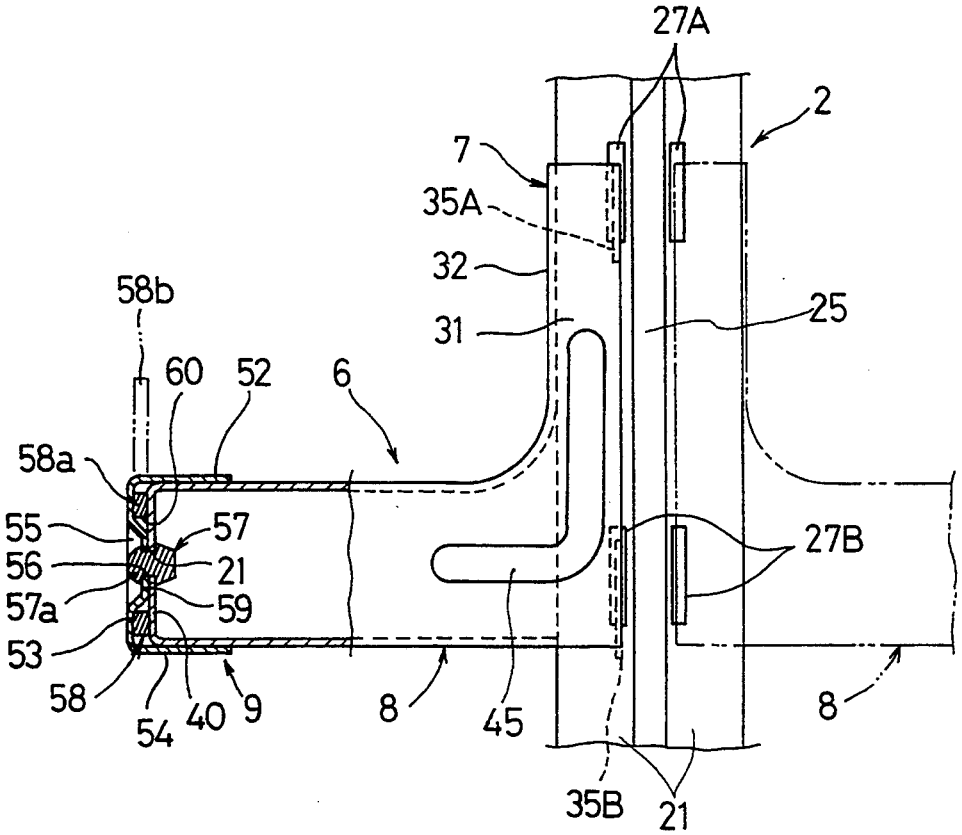
FIGS. 2 and 3 are, respectively, a front view and a plan view showing the portions of the rack assembly shown in FIG. 1 in the assembled condition.
Figure 3:
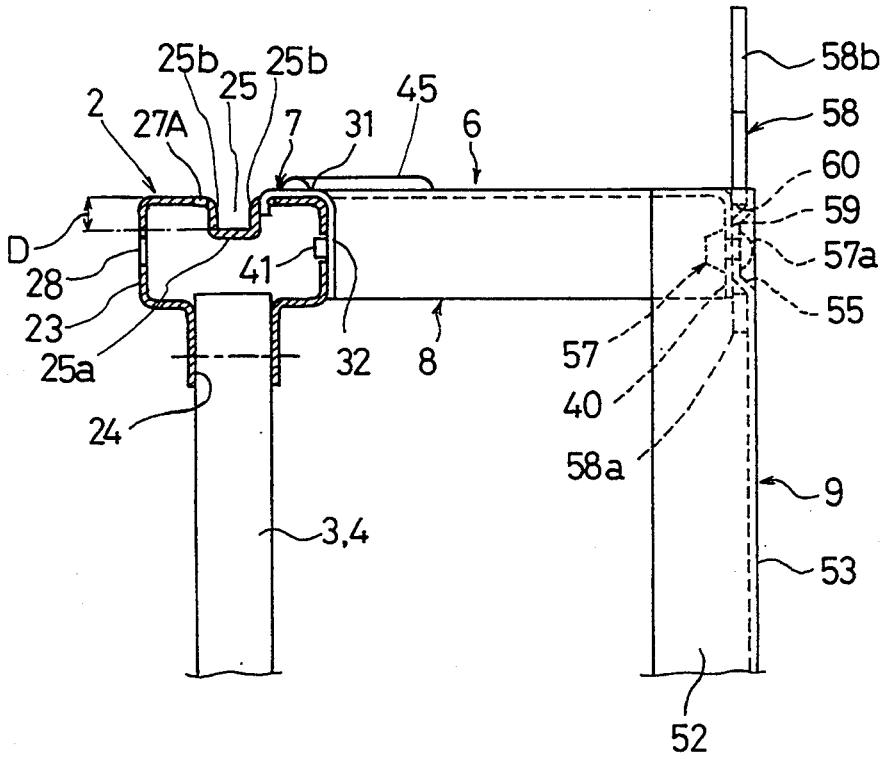

To mount the bracket 6 to the support post 2, the engaging projections 34A, 34B of the bracket 6 are inserted into the corresponding engagement holes 27A, 27B from the position shown by solid line FIG. 1 (in which case the slip-off preventing projection 41 is in abutment with one side plate portion 23 at a level above the slip-off preventing hole 28 through elastic deformation of the connecting member 7), then the bracket 6 is moved downward. The engaging pawls 35A, 35B are locked to the lower edge of the engagement holes 27A, 27B, and the slip-off preventing projection 41 is fitted in the slip-off preventing hole 28. In this manner the bracket 6 can be easily and securely fixed to the support post 6.

Figure 4:
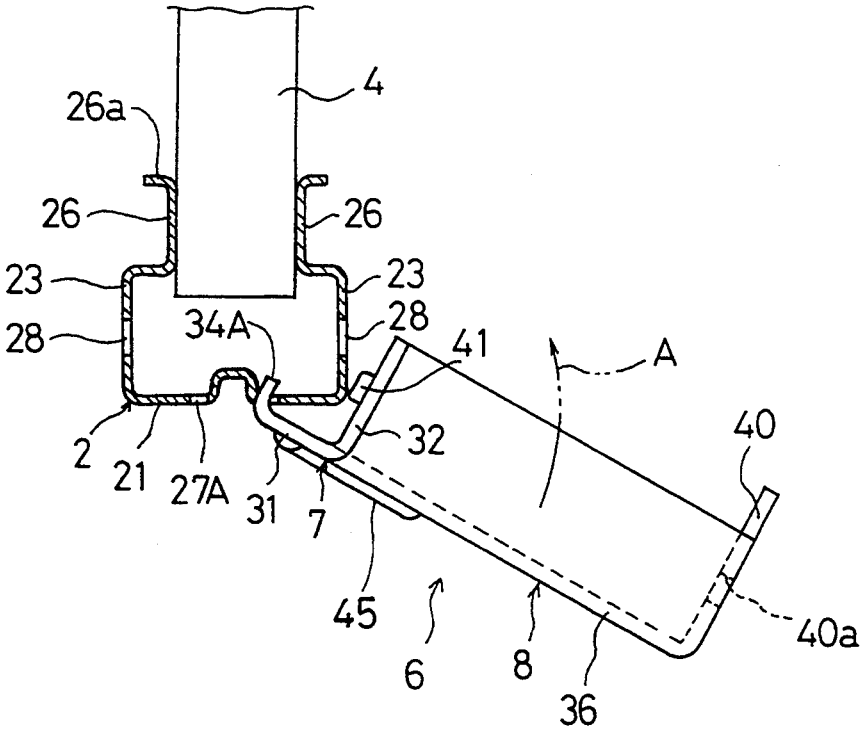
FIG. 4 is a plan view showing the portions shown in FIGS. 1 to 3 in the assembly process.

Otherwise, as FIG. 4 shows, the lower projection 34B is brought into engagement with the corresponding engagement hole 27B while the bracket 6 is held in tilted condition, and then the bracket 6 is erected up to allow the upper engaging projection 34A to engage the engagement hole 34B. Thus, the bracket 6 is put in position ready for attachment to the support post 2 with an inclination of 15° to 30° relative to the support post 2, as shown. Subsequently, the bracket 8 is lowered to allow the locking pawls 35A, 35B to be locked to the lower edge of the engagement holes 27A, 27B, whereby the slip-off preventing hole 28 and the slip-off preventing projection 41 are leveled. Then, the bracket 6 is pivotally moved about proximate positions for engagement of the engagement holes 27A, 27B with the locking pawls 35A, 35B as shown by arrow A. Thereupon, the projection 41 is received in the slip-off preventing hole 28, and the side plate portion 32 goes into abutment with the side plate portion 23, whereby the mounting of the bracket 6 is completed.

The bracket rail 9 has an upper plate 52, a side plate 53, and a lower plate 54, so that it is channel-shaped in section and fittable on the front end portion of the bracket member 8. The side plate 53 is formed at a specified location with a round shaped recessed portion 55 having a through-hole 56 formed centrally thereof which is adapted to match a connecting hole 40*a*. The holes 40*a*, 56 are fixedly connected by a rivet 57 or bolt after they are allowed to match each other, in which case a head 57*a* of the rivet 57 is fitted in the recessed portion 55. The bracket rail 9 can be fabricated by passing a hoop formed with a recessed portion 55 and a through-hole 56 through a conventional roll mill for channel section material forming. It may be obtained in various sizes by effecting positional changes with respect to the mold.

As FIG. 8 shows, the rack 1 can store goods 11 therein in a plurality of tiers. As shown in FIG. 1, a topmost one of the bracket rails 9 which usually has no brace 10 is provided at the rear end thereof with an upwardly extending stopper member 58 which is fixed by a rivet 57. The stopper member 58 is of an L-shaped plate form and has a connecting plate portion 58*a* insertable into the bracket rail 9, and a stopper plate portion 58*b* projecting upward at the rear end of the bracket rail 9. As already stated, the side plate 53 of each bracket rail is formed with a recessed portion 55, which in turn forms an inwardly raised round protrusion 59. The connecting plate portion 58*a* is formed with a mounting hole 60 fittable on the round protrusion 59. The thickness of the connecting plate portion 58*a* is equal or about equal to the thickness of the round protrusion 59. Therefore, the mounting hole 60 is set so as to be ready for receiving the round protrusion 59 before coupling by the rivet 57, whereby the stopper member 58 can easily be fixed to the rear end of the bracket rail 9 through coupling by the rivet 57.

In the case such construction, coupling of each bracket 8 and the associated bracket rail 9 is made through rivet 57 at the fabricating factory, in which case the stopper member 58 is set in position. For each pair of support posts 2 integrally connected depthwise of the rack through horizontals 3 and bracings 4, engaging projections 34A, 34B of associated brackets 8 are brought in engagement with engagement holes 27A, 27B of the support posts 2, whereby a temporary rack assembly is made. Such temporary rack structures are stacked one over another, which are transported together with horizontal beams 5 and braces 10 for assembly into a complete rack at the erection site.

In an automatic warehousing facility, loading and unloading of goods 11 (pallets) onto and from the rack assembly 1 constructed in the manner as described above are carried out by suitable handling means and/or a forklift. For this purpose, loading of incoming goods is carried out in such condition that goods 11 are prevented from contacting the stopper member 58 as shown by phantom lines in FIG. 7. In the event that the goods 11 should be moved off position depthwise of the rack 1 on account of mishandling, earthquake or otherwise, the goods 11 would come in contact with the stopper member 58.

In the above description, a stopper member 58 is provided in each topmost bracket rail 9 which has no brace 10. Alternatively, the stopper member 58 may be provided in a lower bracket rail 9.

A laterally extending stopper member 61 is attached to each bracket rail 9 at a mid-point of the length thereof (as viewed depthwise of the rack 1). More particularly, the side plate 53 of the bracket rail 9 is formed with mounting holes 62, one located slightly inward of the front end of the bracket rail 9 and the other located slightly before the rear end thereof. The stopper member 61 is of a bent plate shape and comprises a connecting plate portion 63 insertable into the bracket rail 9, an arm plate portion 64 bent rectangularly outward from the upper end of the connecting plate portion 63, and a stopper plate portion 65 rectangularly upward from a free end of the arm plate portion 64. The connecting plate portion 63 is formed with a mounting hole 66 registerable with the mounting hole 62. Therefore, the stopper member 61 can be fixedly connected to the bracket rail 9 by driving a rivet 67 (one example of connecting means, which may alternatively be a bolt and a nut; or such connection may take the form of welding) into the mounting holes 62, 66 when the two holes are registered with each other.

In the case of such construction, at the fabricating factory the bracket 8 and the bracket rail 9 are connected to each other by means of rivet 57 and, at same time, the laterally extending stopper member 61 is coupled to the the bracket rail 9 by means of the rivet 67.

Loading and unloading of goods 11 onto and from a rack provided with such stopper member 61 are also carried out by suitable handling means or a forklift as earlier stated. For the purpose of storing incoming goods, arrangement is made for preventing the goods from contacting the stopper member 61; but in the event that the goods 11 should be moved laterally on account of earthquake or otherwise, the goods are stopped by the stopper plate portion 65 of the stopper member 61.

As shown in FIG. 5, a load W applied to the front end of the bracket 6 via the bracket rail 9 because of goods 11 forms a turning moment M about point P at the proximal end of the bracket member 8, thereby to urge the top portion of the connecting member 7 in the direction of the turning moment M. However, the connecting member 7 can positively sustain the moment M since it holds the outer plate portion 21 and side plate portions 23 of the support post 2 by means of the side plate portions 32, front plate portion 31, and engaging projections 34A, 34B, and thus it can withstand a large load W. Furthermore, the strengthening raised portions 45 formed in continuation on the front plate portion 31 and front plate 36 serves to prevent a strain which may otherwise be caused to the front plate portion 31 by load. W. In addition, since the slip-off preventing projetion 41 engages the slip-off preventing hole 28, the bracket 6 will never become disengaged from the support post 2, even if any vibration due to incoming and outgoing movement of goods 11 is tranmitted to the bracket 6.

Figure 9:
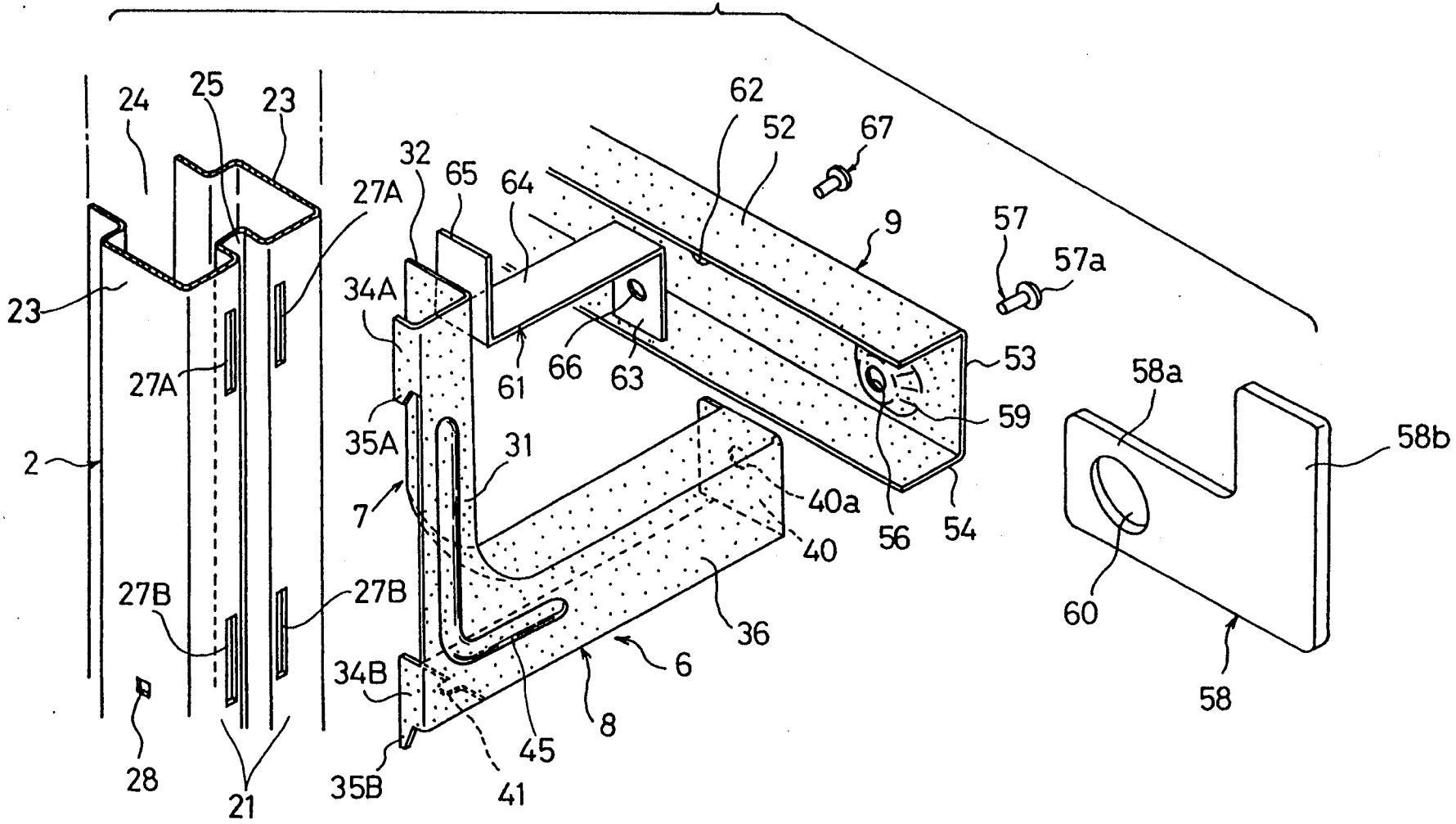
FIG. 9 is a fragmentary exploded view in perspective of the principal portions of the rack assembly explained in a further embodiment of the invention.
Figure 10:
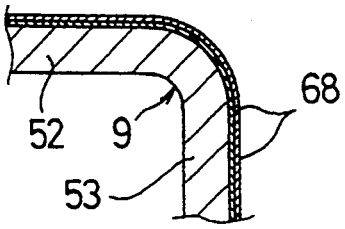
FIG. 10 is a sectional view of the principal portion of the rail shown in FIG. 9.
Figure 11:
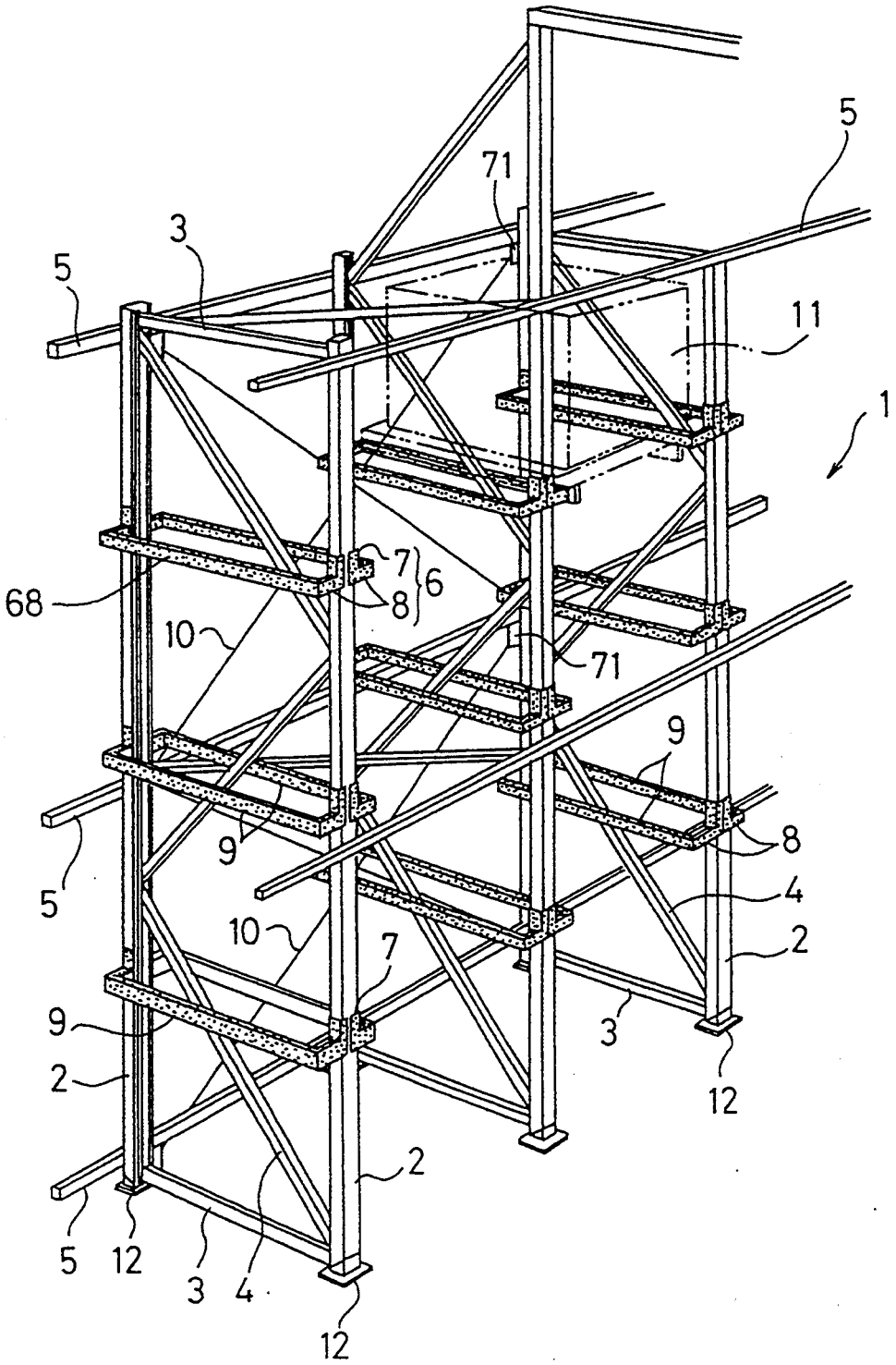
FIG. 11 is a general view in persective of the rack assembly including the portions shown in FIGS. 9 and 10.

FIGS. 9 to 11 illustrate a furter embodiment of the invention. As shown in the drawings, the bracket rail 9 and bracket 6 are differently colored from the support post 2 with respect to their entire outer surface. The bracket rail 9 and bracket 6 may either be colored the same or differently, as for as they are colored differently from the support post 2. Such discrimination in color may be effected by fabricating the the bracket rail 9 and the bracket 6 from a material different from that of the support post 2, or by applying two coats of a paint 68 as shown in FIG. 10. The paint may be applied in one coat, or three or more coats. For the paint, a rust preventive paint may be used.

According to such arrangement, bracket rails 9 and brackets 6 can be distinctly relieved against support posts 2, etc., especially the connecting member 7 of the bracket 6 has the front plate portion 31 which partially covers the outer plate portion 21 of the support post 2, whereby the size or number of tiers of the rack 1 can easily be recognized. Any off-position of stored goods 11 can readily be found out. Also, the fork of the forklift truck can be easily and accurately leveled to position. When the fork contacts the bracket rail 9, the paint 68 will come off, so that the base material of the bracket rail 9, or an inner layer paint of a different color may be exposed. Thus, it is possible to know that such contact has occurred.

In the foregoing embodiment, both the bracket rail 9 and the bracket 6 are differently colored from the support post 2. Alternatively, the bracket rail 9 only may be differently colored.

Figure 12:
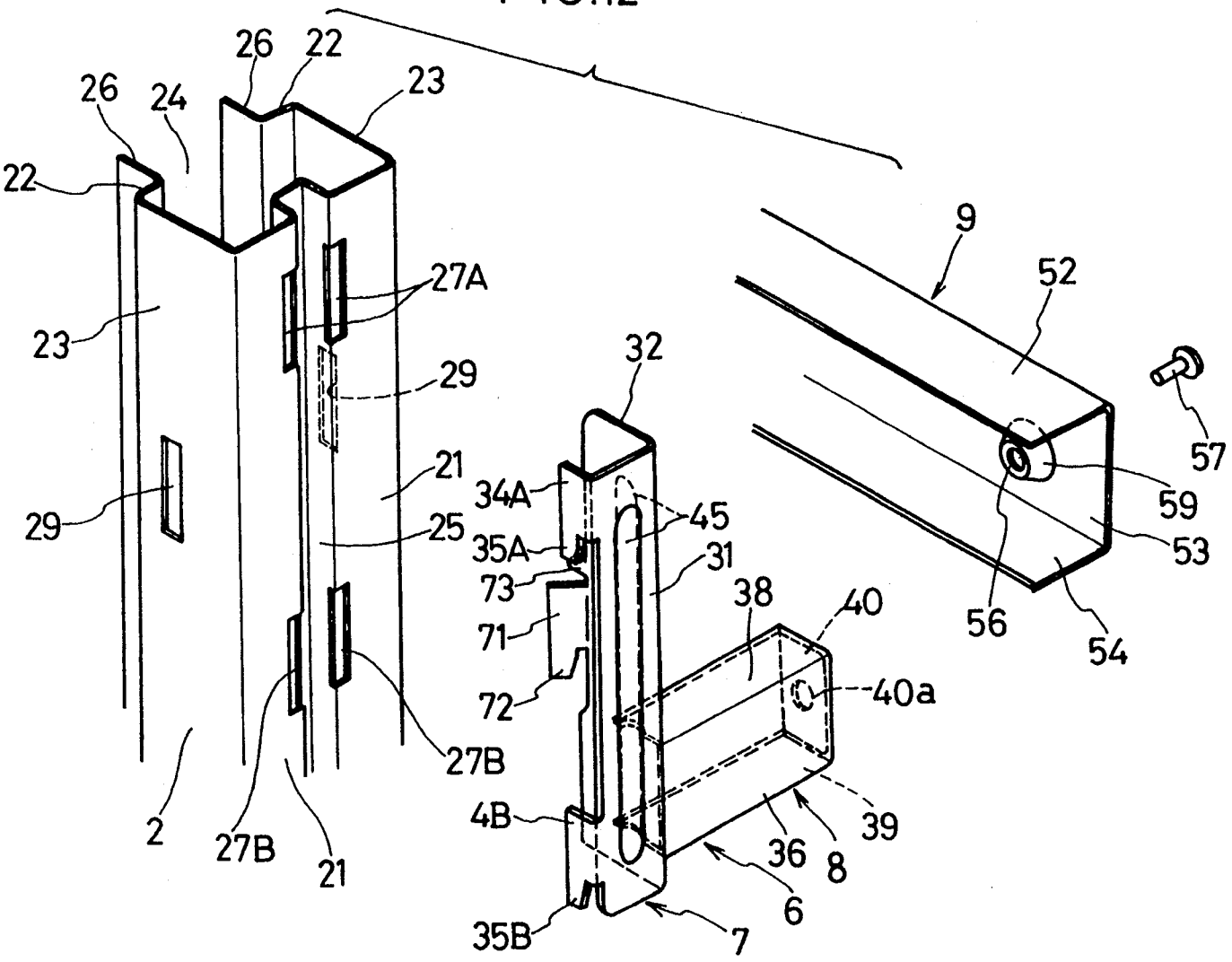
FIG. 12 is a fragmentary exploded view in perspective showing the principal portions of the rack assembly explained in a still further embodiment of the invention.
Figure 13:
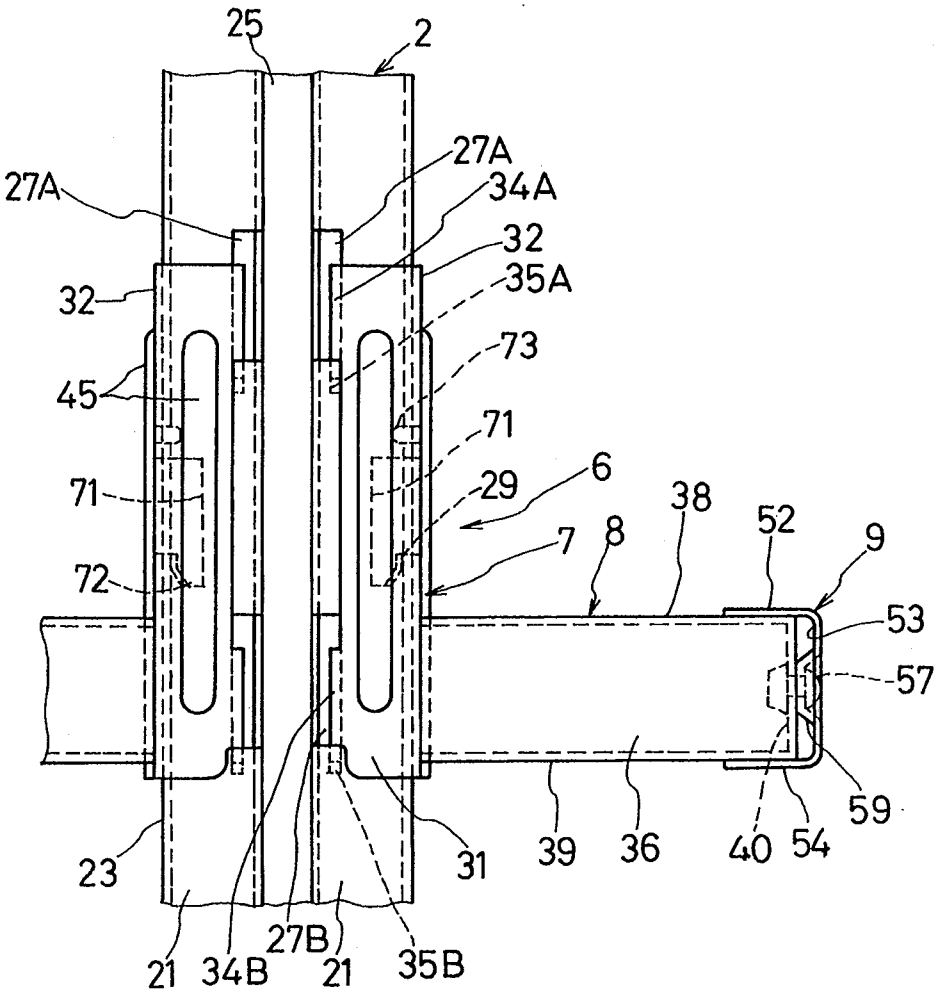
FIGS. 13 and 14 are, respectively, a front view and a plan view of the portions of the rack assembly shown in FIG. 12.
Figure 14:
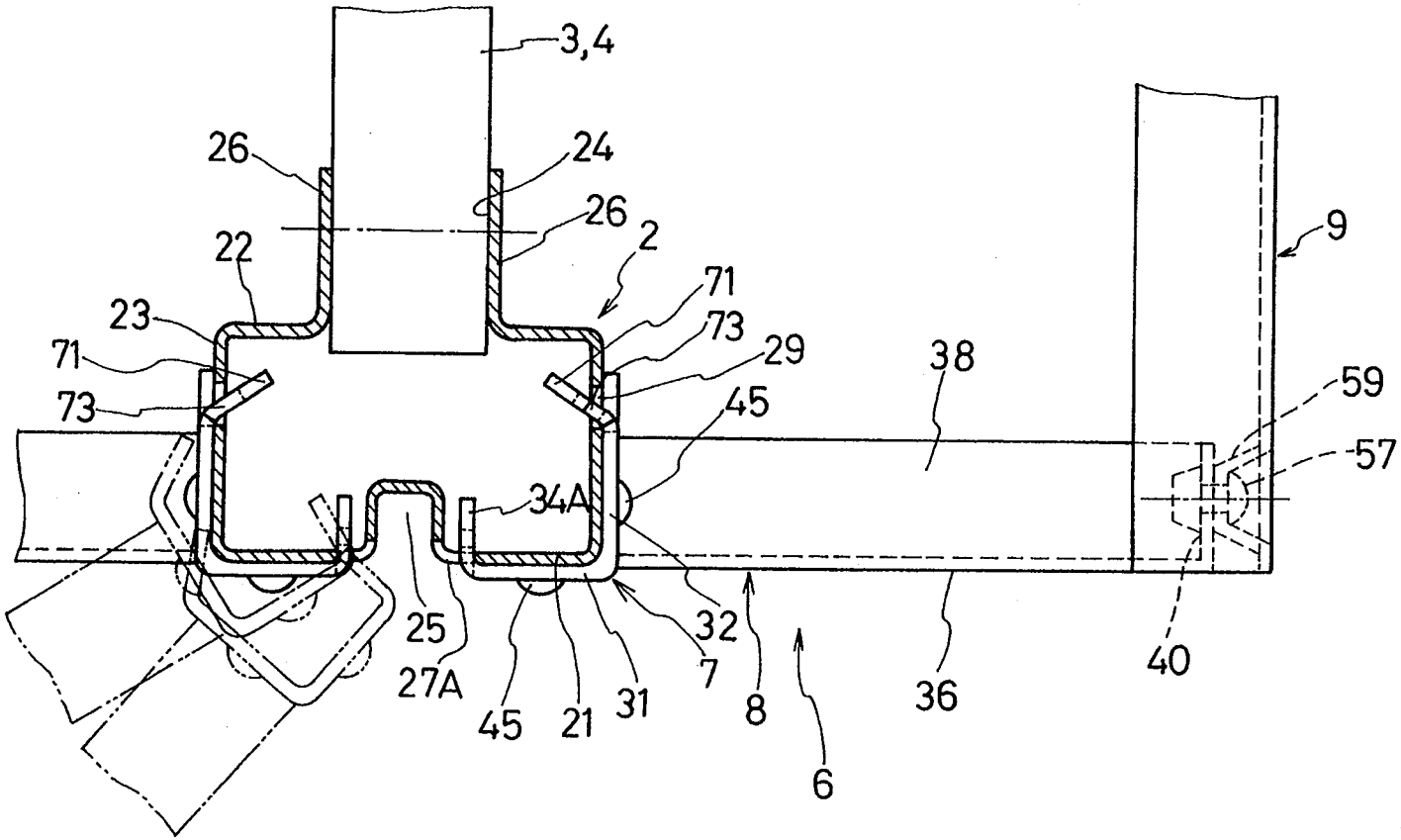

FIGS. 12 to 14 illustrate a still further embodiment of the invention. In this embodiment, vertically-long engagement holes 29 are formed in the side plate portions 23 of the support post 2 at the location corresponding to the mid-point between the engagement holes 27A, 27B. The connecting member 7 and the bracket member 8 of the bracket 6 are different component bodies and integrated into one body by welding or the like.

Formed at the middle of the vertical edge portion of the side plate portion 32 of the connecting member 7 is an engaging projection 71 which is bent 45° in alignment with the front plate portion 31 and insertable into the engagement hole 29. A locking pawl 72 is provided downward from the lower end of the engagement projection 71 to be engageable with the lower edge of said engagement hole 29. Furthermore, formed to be deformable under pressing force at a location slightly above the engaging projection 71 formed on the edge portion of the side plate portion 32 is a locking piece 73 which is insertable into the upper portion of the engaging hole 29 when locking pawls 35A, 35B, 72 are engaged with respective engagement holes. Vertically extended strengthening raised portions 45 for reinforcement are formed linearly on the front plate portion 31 and side plate portion 32 by bead welding (pressing process to inflate a flat plate) or the like.

The bracket member 8, a different component body from the connecting member 7 as mentioned above, is formed in a channel shape with a front plate 36 continuing as a plane from the lower portion of the front plate portion 31 of connecting member 7, an upper plate 38 making a right angle with the side plate portion 32 of the connecting member 7 and a lower plate 39 in a parallel relation to said upper plate 38. And an end plate 40 having a connecting hole **40*a*** is provided at the end side.

When the bracket 6 is connected to the support post 2, the locking piece 73 of the bracket 6 is in the state of the same plane as the side plate portion 32. In said state the bracket 6 is brought close to the support post 2 from the front side slantwise, then the engaging projections 34A, 34B formed on the connecting member 7 are inserted into the engagement holes 27A, 27B formed in the outer plate portion 21. Then, the connecting member 7 is moved pivotally in order to insert the engaging projection 7 of the connecting member 7 into the engagement hole 29 formed in the side plate portion 23 of the support post 2. In this way, the side plate portion 32 and front plate portion 31 of the connecting member 7 are firmly secured to the side plate portion 23 and outer plate portion 21 of the support post 2 respectively.

In the next place, the bracket 6 is lowered so as to lower the engaging projections 34A, 34B, 71 within the engagement holes 27A, 27B, 29, so that respective locking pawls 35A, 35B, 72 are engaged with the lower edge of the engagement holes 27A, 27B, 29. By this, the bracket 6 is prevented from falling off frontward or sideway from the support post 2. In this state of engagement, the locking piece 73 is deformed under pressing force and inserted into the upper portion of the engagement hole 29. Consequently, the bracket 6 is prevented form moving upward, being mounted to the support post 2 firmly and with ease.

It is also possible to form a T-shape bracket 6 in such a construction that the bracket member 8 is arranged at the central portion of the connecting member 7. Although exemplified in the foregoing is the construction having a single engagement hole 29 and a single engaging projection 71, it is also possible to provide a plurality of engagement holes and engaging projections respectivey arranged vertically spaced apart.

FIGS. 15 to 23 show another embodiment of the invention.

In these drawings, a seating member 12 comprises a pair of side plate portions 92 erected by welding on a base plate 91 and abuttable against the outer surface of the side plate portion 23 of a support post 2, and a front plate portion 93 abuttable against the outer surface of the outer plate portion 21 of the support post 2, and has a C-shape structure formed by the side plate portions 92 and the front plate portion 93 in combination. The side plate portions 23 of the support post 2, at respective lower ends thereof, and the side plate portions 92 of the seating member 12, are respectively formed with connecting holes **23*a*, 92*a*. The lower end of support post 2 is fitted in the plate portions 92, 93 of the seating member 12, and a pin 95 (one example of connecting means) is fitted into each of the connecting holes 23*a*, 92*a*. Then, slip-off preventing means is provided by caulking or otherwise. Thus, the seating member 12 is securely mounted to the support post 2**.

Figure 17:
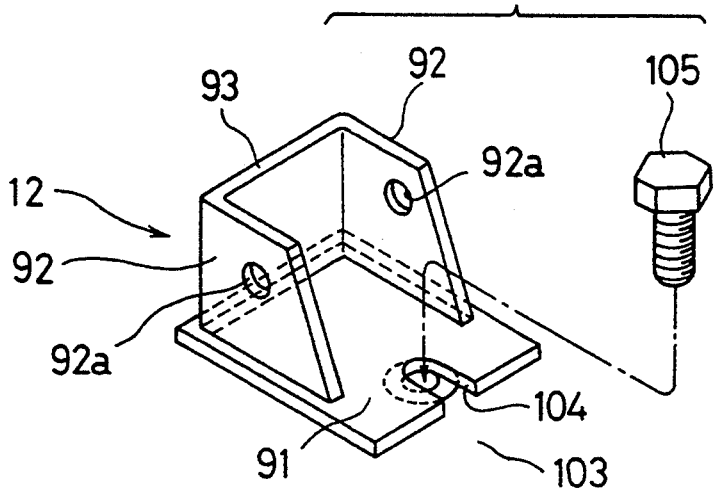
FIGS. 17 to 19 are views showing modified forms of base plates and seating members.

Shown by 96 is a leveling adjuster which comprises a nut member 98 fixed to the underside of the base plate 91 in corresponding relation to a through-hole 97 formed centrally of the base plate 91, a fixing plate 99, and a bolt member 100 rotatably erected on the fixing plate 99 and threadingly enagageable with the nut member 98. The fixing plate 99 is fixed to a floor 103 through engagement of a bolt 101 with a fixing cut-out hole 102. The adjuster 96 is employed in an automatic warehousing facility or the like facility in which level adjustment of bracket rails 9 is required. Where no such adjuster 96 is provided, a base plate 91 formed with a fixing cut-out hole 104 is mounted directly to the floor 103, as shown in FIG. 17.

Figure 18:
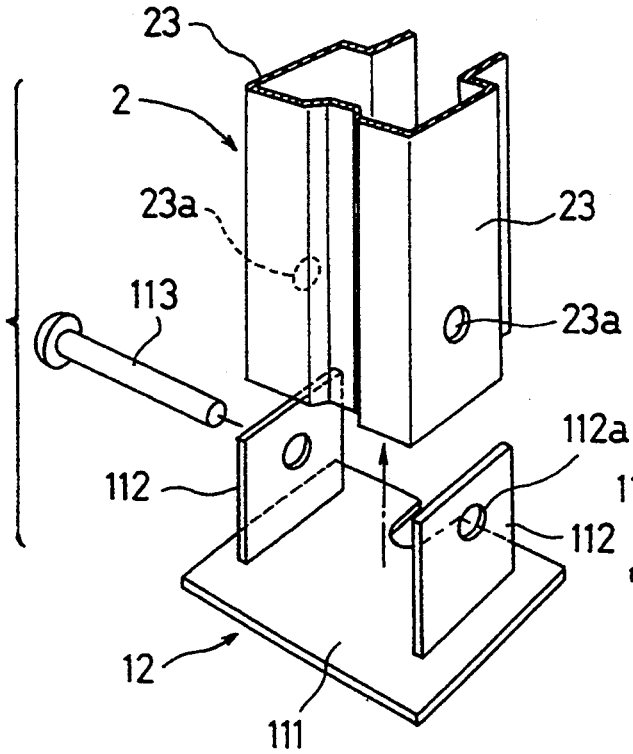
Figure 19:
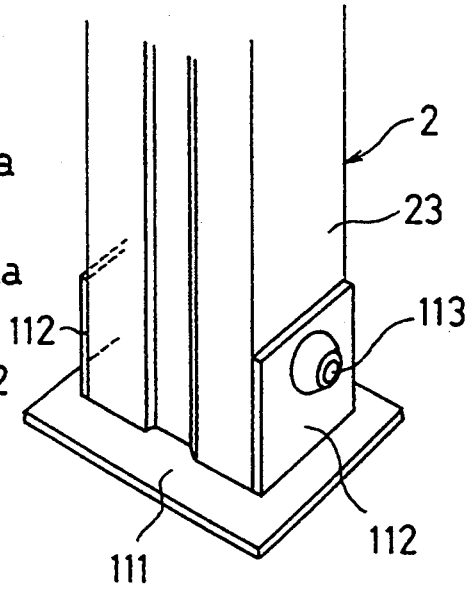

FIGS. 18 and 19 show a modified form of seating member 12. In this example, a pair of side plate portions 112 are erected by welding on a base plate 111, the side plate portions 112 being abuttable against the underside of the side plate portions 23 of the support post 2. The seating member 12 is connected to the support post 2 by inserting a pin into connecting holes 112*a*, 23*a* formed respectively in the side plate portions 112 and support post 2.

In the case of the above described arrangement, plate portions 92, 93, 112 are abuttable against the outer surface of the side plate portions 23 and outer plate portion 21 of the support post 2. Alternatively, they may be made abuttable against the inner surface.

According to such arrangement, the seating member 12 can easily be mounted to the lower end to the support post 2. Also, by giving some allowance to the connecting portion it is possible to adjust the connecting portion to meet the condition of floor surface at the erection site. Further, since the support post 2 can be tansported without the seating member 12 being mounted thereto, there is no possibility of the seating member 12 being a cause of a trouble during transport.

Figure 15:
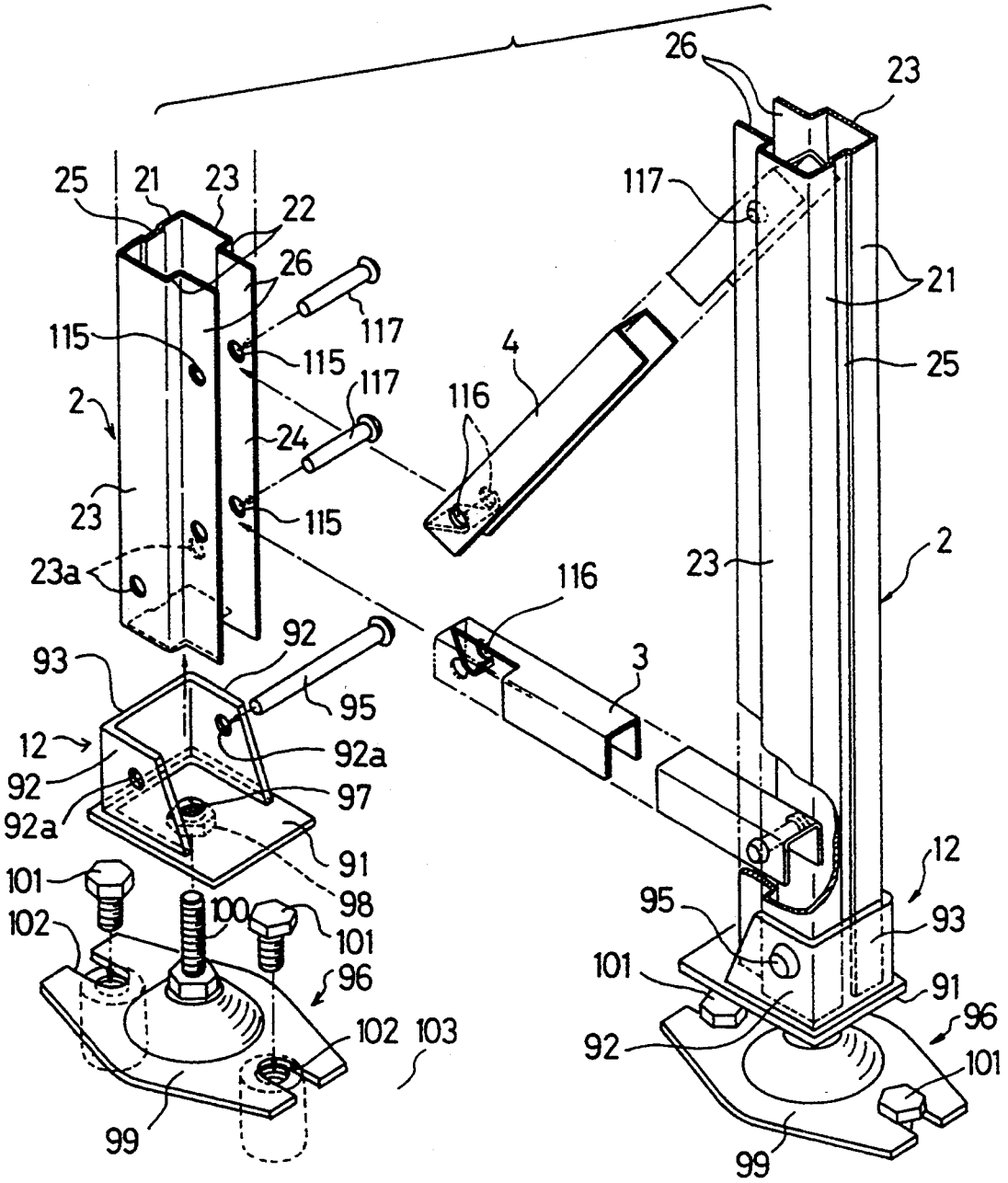
FIG. 15 is a fragmentary exploded view in perspective of a rack assembly representing a still further embodiment of the invention.
Figure 16:
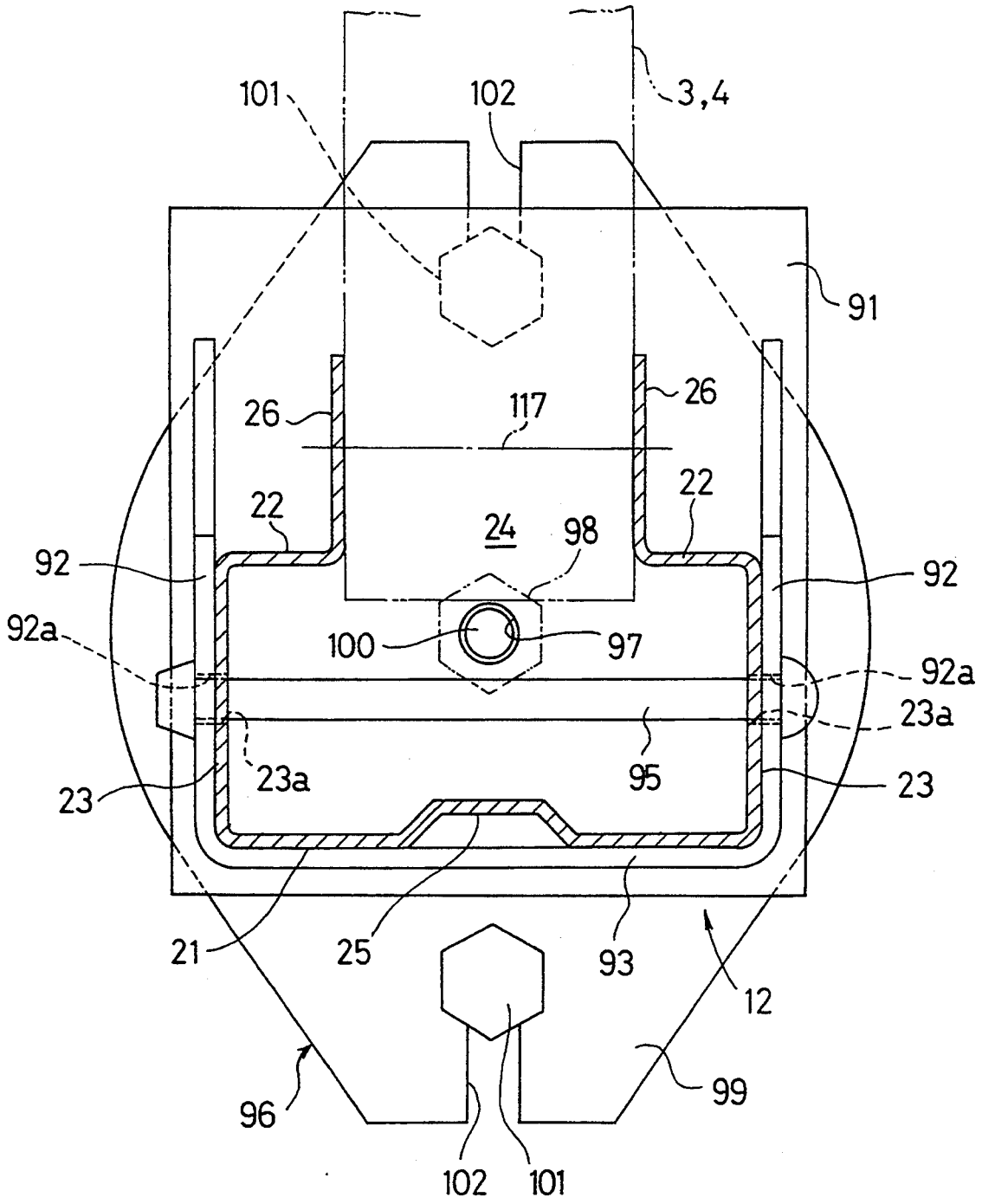
FIG. 16 is a plan view showing portions of the rack assembly in FIG. 15.
Figure 20:
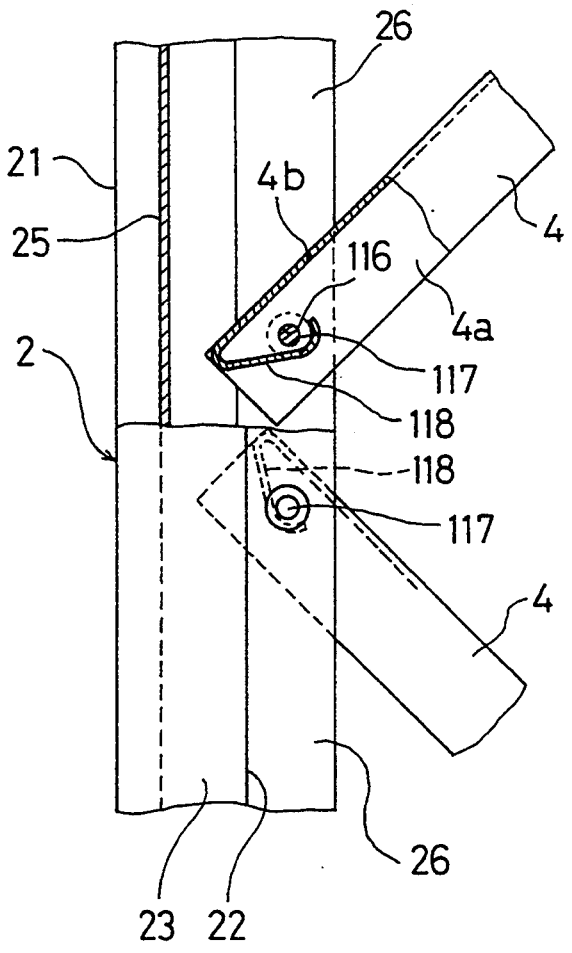
FIGS. 20 and 21 are side and plan views showing other portions of the rack assembly in FIG. 15.
Figure 21:
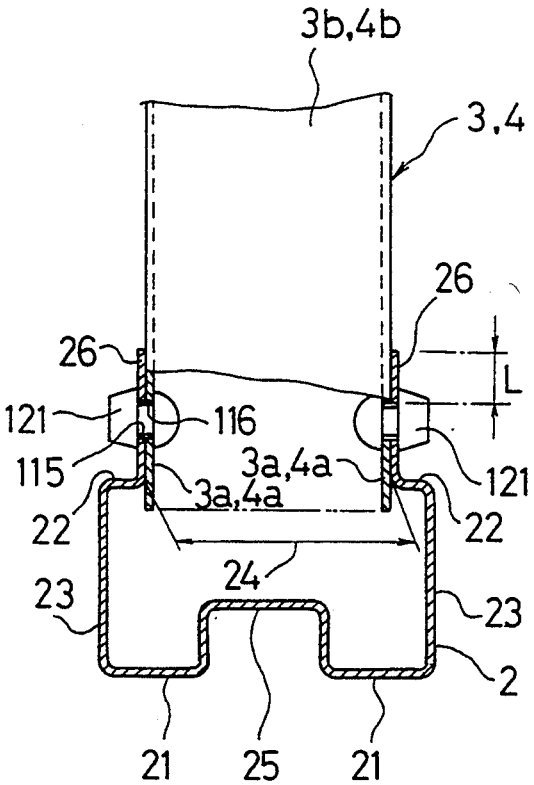

As shown, for the horizontal 3 and bracing 4 to be mounted between support posts 2, a channel material is used which has a pair of side plates 3*a*, 4*a* opposed to each other and connecting plates 3*b*, 4*b* whose respective side edges connect the side plates 3*a*, 4*a*. As FIG. 15 shows, a pair of support posts 2 are disposed in opposed relation, one at the inner side and the other at the front side. Between connecting plate portions 26 formed with connecting holes 115 are inserted a horizontal 3 and a bracing 4 which have side plates 3*a*,4*a* formed with connecting holes 116. A pin 117 is inserted into the connecting holes 115, 116, then caulking is effected whereby the horizontal 3 and bracing 4 are fastened in position. As FIG. 20 shows, the horizontal 3 and bracing 4 is each formed with a strengthening portion 118 such that connecting plate 3*a*, 3*b* is bent back between the side plates 3*a*, 4*b* toward the proximity of the connecting hole 116, whereby the horizontal 3 and bracing 4 are prevented from becoming deformed by tightening of the pin 117. For the connecting means, one long pin 117 only which extends through the connecting plate portions 26 may be used, or as FIG. 21 shows, two rivets 121, one for each connecting plate portion 26, may be used.

Figure 22:
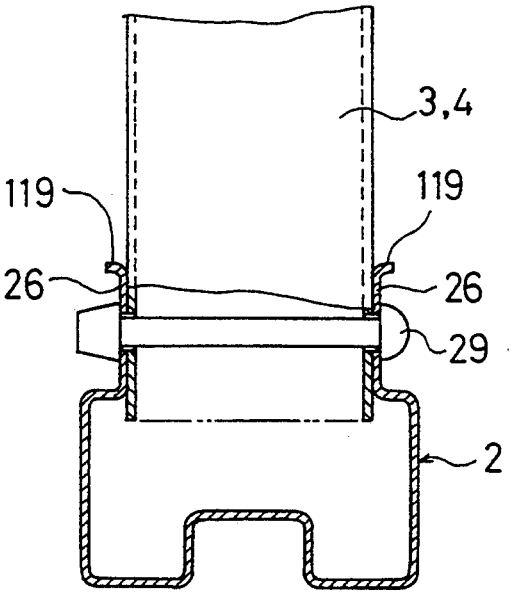
FIGS. 22 and 23 are plan views showing modified forms of the portions shown in FIG. 21.

FIG. 22 shows another modified form. The combined strength of the support post 2 and the horizontal 3 or bracing 4 is, as show in FIG. 21, greatly influenced by a sear strength over a distance L between the connecting hole 115 and the front edge of the connecting plate portion 26. In view of this fact, a bent back portion 119 formed by bending 90° the front edge of the connecting plate portion 26 laterally is provided which extends over the entire length of the connecting plate portion 26, to improve the shear strength of the connected portion.

Figure 23:
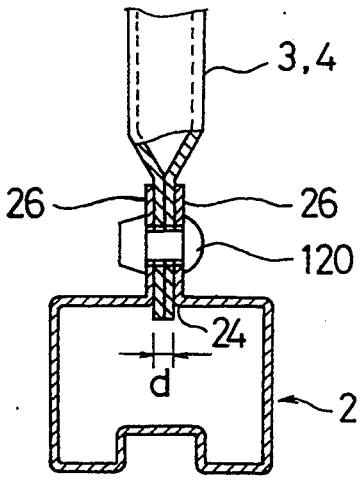

FIG. 23 shows another modified form. The space d between slits 24 in the support post 2 is rather narrow. In this case, ends of the horizontal 3 and bracing 4 are formed flat by pressing or otherwise, which are inserted between connecting plate portions 26 and fixed by rivet 120. In this modified form, a cylindrical pipe may be used for the horizontal 3 and bracing 4.

For the connecting means, bolts and nuts may be used in place of above mentioned pins 117 or rivets 120, 121.

According to the above described arrangement, the horizontal 3 and bracing 4 are inserted between the connecting plate portions 26 of the support post 2 and fixed by connecting means, whereby assembly work can easily be carried out at the erection site. This eliminates the need for welding operation during assembly work, permits transport of the rack 1 in the form of unit parts, and thus enables transport cost reduction.

What is claimed is:

1. A rack assembly comprising:

a vertically extending support post;

a member to be mounted to said support post;

said support post consisting of an outer plate portion and a pair of side plate portions so as to be in a shape of a profile, said outer plate portion and each of said side plate portions having at least one vertically elongated engagement hole;

said member having a front plate portion adapted to abut on said outer plate portion of said support post and a side plate portion adapted to abut on one of said side plate portions of said support post;

at least one first engaging projection formed integrally with said front plate portion, bent perpendicularly to said front plate portion and adapted to be inserted into said engagement hole formed in said outer plate portion of said support post;

at least one second engaging projection formed integrally with said side plate portion of said member, bent obliquely in alignment with said front plate portion and adapted to be inserted into said engagement hole formed in said side plate portion of said support post;

said first engaging projection inserted into said engagement hole formed in said outer plate portion when said member is brought close to said support post from the front side slantwise;

said second engaging projection inserted into said engagement hole formed in said side plate portion of said support post when said member is moved pivotally after inserting said first engaging projection into said engagement hole formed in said outer plate portion in order to abut said front and side plate portions of said member on said outer and side plate portions of said support post respectively;

first and second locking pawls formed integrally with and extending downwardly from lower portions of said first and second engaging projections respectively in such a manner that, when said member is lowered after inserting said first and second engaging projections into said engagement holes in said outer plate portion and said side plate portion of said support post respectively, said first and second locking pawls engage with a lower edge of said engagement holes; and a third locking pawl which is plastically deformable so as to be incapable after being bent of returning to its original form, said third locking pawl being formed integrally with said member at a location above said second engaging projection in such a manner that, when said first and second locking pawls have been engaged with said lower edge of said engagement holes after inserting said first and second engaging projections into said engagement holes respectively, said third locking pawl is in the state of the same plane as said side plate portion of said member and then said third locking pawl is subjected to plastic deformation and is inserted into said engagement hole partially occupied by said second engaging projection and disposed above said second engaging projection.

2. A rack assembly as claimed in claim 1 wherein said outer plate portion of said support post has a pair of said engagement holes spaced vertically from each other and said member has a pair of said first engaging projections adapted to mate with said pair of engagement holes.

* * * * *